US007131699B2

(12) United States Patent
Mulmed

(10) Patent No.: US 7,131,699 B2
(45) Date of Patent: Nov. 7, 2006

(54) FURNITURE WITH SEATING SPACE AND ENTERTAINMENT CENTER

(75) Inventor: Theresa A. Mulmed, Scottsdale, AZ (US)

(73) Assignee: Dodaz, Inc., Scottsdale, AZ (US)

( * ) Notice: Subject to any disclaimer, the term of this patent is extended or adjusted under 35 U.S.C. 154(b) by 0 days.

(21) Appl. No.: 11/059,162

(22) Filed: Feb. 15, 2005

(65) Prior Publication Data

US 2006/0181115 A1 Aug. 17, 2006

(51) Int. Cl.
*A47C 7/00* (2006.01)
*A47C 7/62* (2006.01)

(52) U.S. Cl. ..... 297/440.14; 297/217.4; 297/188.01

(58) Field of Classification Search ..... 297/217.5, 297/217.4, 217.3, 188.13, 188.11, 188.09, 297/440.14, 249, 257, 188.01, 423.41, 188.2, 297/188.21; D6/337, 336, 357, 378, 335
See application file for complete search history.

(56) References Cited

U.S. PATENT DOCUMENTS

| | | | | | |
|---|---|---|---|---|---|
| 1,961,457 | A * | 6/1934 | Schnelder | 297/121 |
| 2,145,201 | A * | 1/1939 | Raeuber | 297/142 |
| D143,454 | S * | 1/1946 | White | D6/484 |
| D212,534 | S * | 10/1968 | Borenstein | D6/335 |
| 3,608,101 | A * | 9/1971 | Castro et al. | 5/2.1 |
| 3,818,609 | A * | 6/1974 | Woolman | 434/237 |
| 3,822,078 | A * | 7/1974 | Spadolini | 297/140 |
| D235,908 | S * | 7/1975 | Rosenwach | D11/144 |
| 3,955,850 | A | 5/1976 | Toso | |
| D273,732 | S * | 5/1984 | Tiffany | D6/335 |
| D290,663 | S * | 7/1987 | Jung | D6/337 |
| 5,083,838 | A * | 1/1992 | Maxwell, Jr. | 297/244 |
| 5,318,340 | A * | 6/1994 | Henry | 297/232 |
| D366,770 | S * | 2/1996 | Mabon | D6/336 |
| 5,865,501 | A * | 2/1999 | Eisenberg et al. | 297/158.5 |
| 6,106,058 | A * | 8/2000 | Sur et al. | 297/188.19 |
| 6,174,026 | B1 * | 1/2001 | Wise | 297/120 |
| 6,296,314 | B1 * | 10/2001 | Klein | 297/440.14 |
| 6,739,670 | B1 * | 5/2004 | Johnson | 297/423.41 |

* cited by examiner

*Primary Examiner*—Milton Nelson, Jr.
(74) *Attorney, Agent, or Firm*—Robert D. Atkins; Quarles & Brady Streich Lang LLP

(57) ABSTRACT

An assembly of outdoor furniture has an entertainment center centrally integrated with a plurality of interconnected seating units, which are disposed adjacent to and around the entertainment center. The entertainment center can be a container having an interior volume for storage of items such as toys, games, and equipment. An enclosure covers the container. The enclosure uses weather striping for protection against the elements. The entertainment center can also provide refrigeration for beverage and food storage. The interconnected seating units form a rectangular or circular assembly. Each of the interconnected seating units has a lower assembly and a cushion placed over the lower assembly. A plurality of benches can mate with the interconnected seating units. The benches can be mechanically coupled to the interconnected seating units.

20 Claims, 2 Drawing Sheets

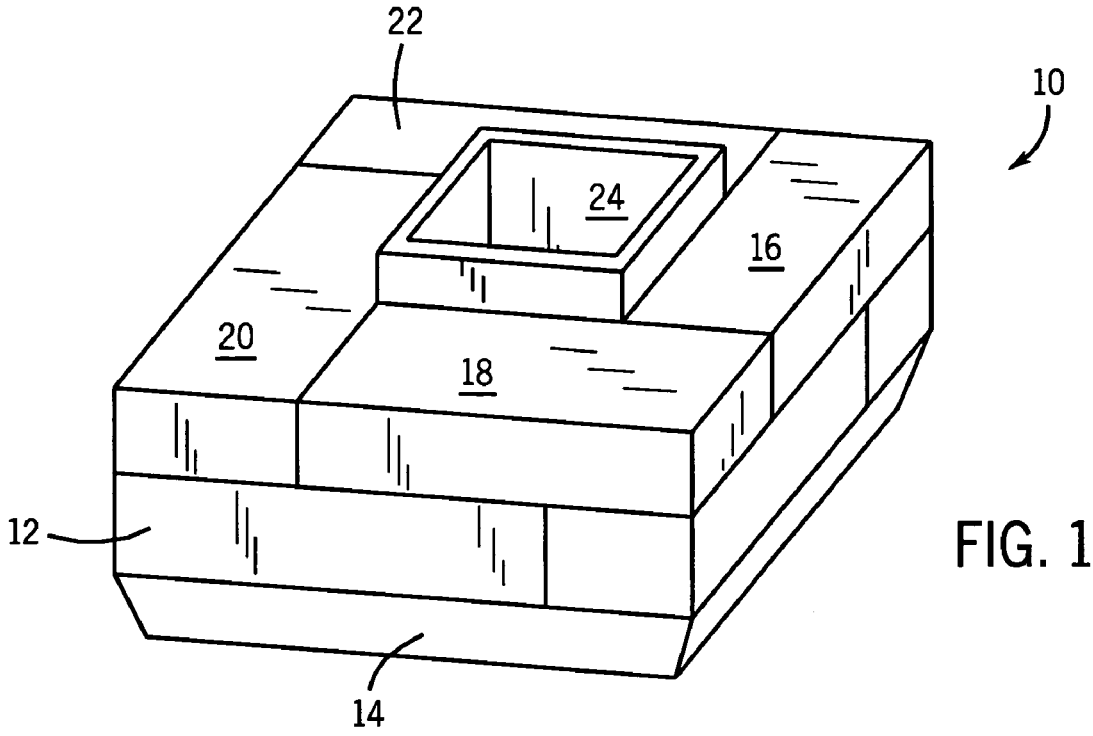
FIG. 1
FIG. 2
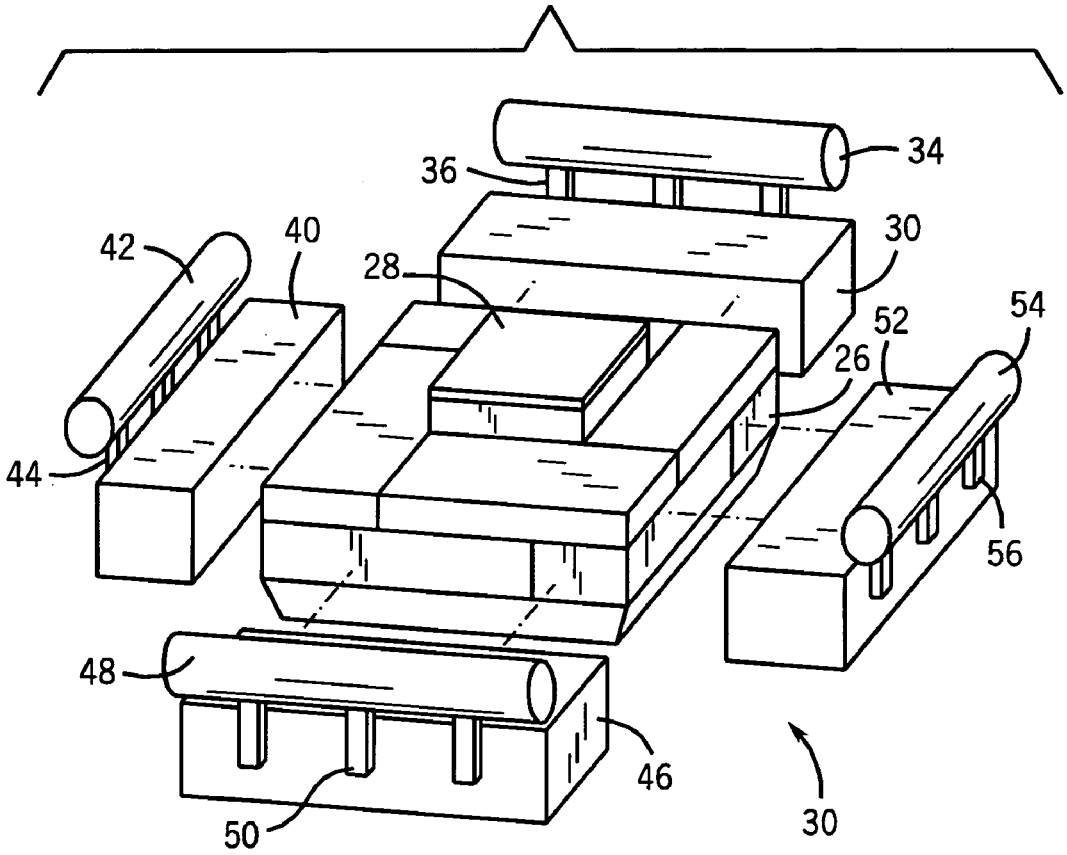

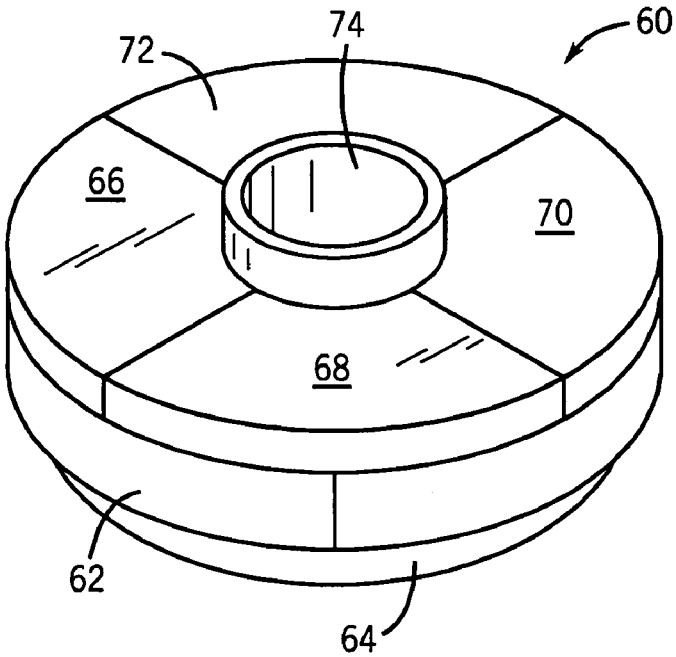
FIG. 3
FIG. 4
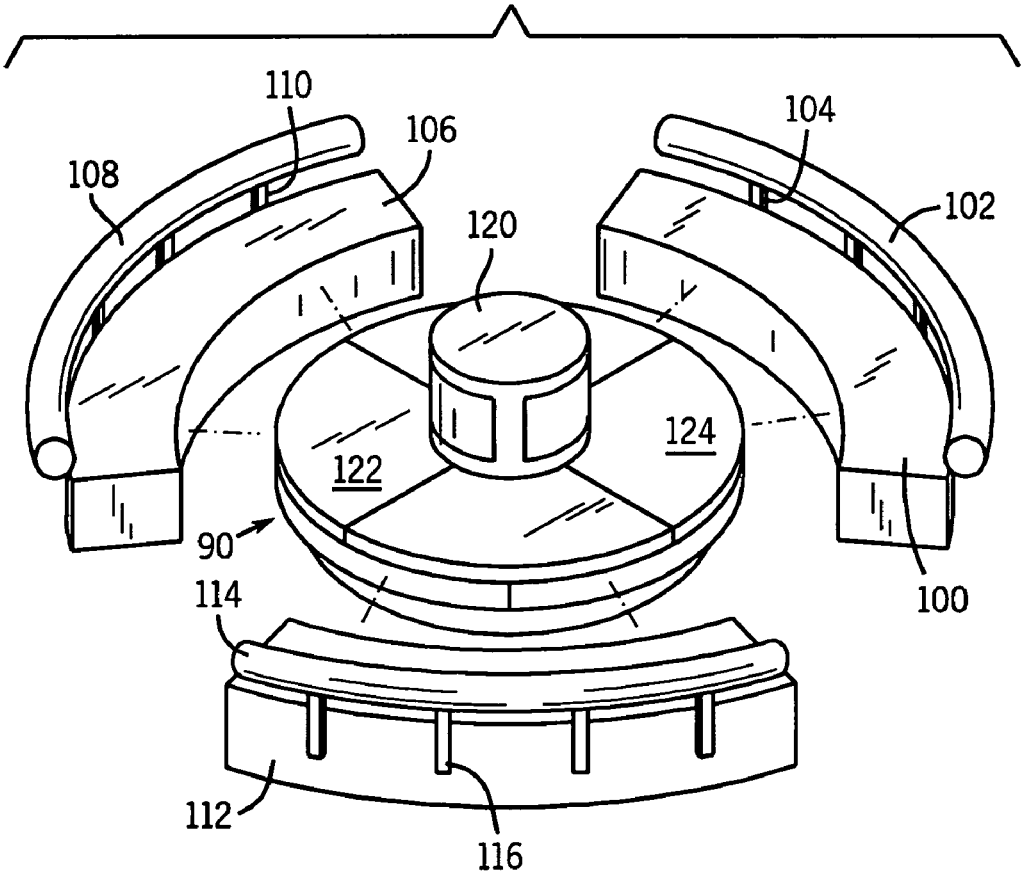

FURNITURE WITH SEATING SPACE AND ENTERTAINMENT CENTER

The present patent application is related to copending U.S. patent application Ser. No. 11/059,095, entitled "Furniture Designed for Sitting and having Inner Core Support Assembly" and filed concurrently herewith by Theresa A. Mulmed. The present patent application is further related to copending U.S. patent application Ser. No. 11/059,211, entitled "Composite Assembly of interconnectable Furniture" and filed concurrently herewith by Theresa A. Mulmed.

FIELD OF THE INVENTION

The present invention relates in general to furniture and furnishings, more particularly, to furniture having seating space and entertainment center.

BACKGROUND OF THE INVENTION

Furniture is found in virtually every home, business, office, and many outdoor settings. Furniture performs a variety of useful functions such as providing seating places and flat surfaces for placing items. Each type of furniture is usually designed for one single utilization. For example, a single chair is intended to comfortably support the weight and form of one person. A sofa or sectional will easily accommodate more than one person. A table top is designed to support smaller items such as beverage containers, plates of food, personal items, and decorations.

Consider an outdoor setting where the user wants to set up chairs and a coffee table. The chairs are positioned around the coffee table. Each person can use a portion of the table for their food, beverages, and personnel items. The host may place a decorative item, such as floors, candle, or center piece on the table top. The functional options for the chairs and table top combination are somewhat limited in terms of versatility. The chairs continue to be used for seating and the table top continues to be used for a convenient surface to place items. There is little or no integration or multi-functional roles of the individual furniture units. The separate pieces continue to function as separate and detached articles of furniture.

A need exists for furniture designed and constructed for integrated functions.

SUMMARY OF THE INVENTION

In one embodiment, the present invention is an assembly of outdoor furniture, comprising a storage container having an interior volume. A plurality of interconnected seating units are disposed adjacent to and around the container.

In another embodiment, the present invention is an assembly of outdoor furniture, comprising a plurality of seating units disposed around a circumference. An entertainment center is integrated into a central portion of the plurality of seating units.

In another embodiment, the present invention is an article of furniture, comprising a user utilization center. A plurality of seating units are disposed adjacent to and around the user utilization center.

In another embodiment, the present invention is an method of making an assembly of outdoor furniture, comprising providing a container having an interior volume for storage, and providing a plurality of interconnected seating units disposed adjacent to and around the container.

BRIEF DESCRIPTION OF THE DRAWINGS

FIG. 1 illustrates a rectangular article of furniture with a centrally integrated entertainment center;

FIG. 2 illustrates the article of furniture with centrally integrated entertainment center and surrounding straight benches with backrests;

FIG. 3 illustrates a circular article of furniture with a centrally integrated entertainment center; and FIG. 4 illustrates the article of furniture with centrally integrated entertainment center and surrounding curved benches with backrests.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Referring to FIG. 1, an article of furniture 10 is designed for sitting purposes and shown as suitable for supporting the weight of one or more adult persons. Furniture unit 10 is useful for many applications including home, office, industry, and outdoor spaces. Furniture unit 10 is durable, inexpensive, and may be used in outdoor settings such as on the patio, under the gazebo, and around the pool for relaxing and entertaining.

Furniture unit 10 has a lower assembly 12 which rests on base 14. Base 14 can be made with wood, metal, or other suitable material capability of providing a stable structural support for furniture unit 10. The lower assembly 12 is made in four rectangular sections. The end of one rectangular section is placed adjacent to the side of another section as shown in FIG. 1 to form a generally square lower assembly 12. In one embodiment, the lower assembly 12 measures about 100 by 100 inches.

Each section of the lower assembly 12 has an inner core assembly (not shown). The inner core assembly has a box frame structure made with interconnected bars. A plurality of vertical bars connect between upper and lower bar components of the box frame on each side of the inner core assembly. A plurality of horizontal bars connect opposite sides of the upper portion of the box frame. The horizontal bars provide a structural weight-bearing support across the horizontal upper portion of the inner core assembly. The inner core assembly can be made of metal, wood, polymer, or other weight-bearing material. The inner core assembly is sufficiently rigid and sturdy to support the weight of one or more adult persons without noticeable bending or deformation. The structure of the inner core assembly maintains its shape and rigidity beyond the useful service life of the sitting furniture. The sides of inner core assembly are covered with cloth pad or foam cushions. The cloth pad or foam cushion side coverings may be 1–2 inches in thickness. A cloth pad or foam cushion top covering is disposed over the horizontal top portion of the inner core assembly. The lower assembly is then covered with a fabric material. The exterior fabric material is water proof, washable, and resistance to sun exposure and other outside elements. The inner core assembly is more fully disclosed in corresponding U.S. patent application entitled "Furniture Designed for Sitting and having Inner Core Support Assembly" as cross referenced above, which is incorporated herein by reference.

An upper assembly of furniture unit 10 includes four cushions 16, 18, 20, and 22 made of foam or padded material. The cushions 16–22 are covered with a similar exterior fabric material as lower assembly 12. The exterior fabric provides a visually appealing and durable surface against outside elements which can be easily cleaned and maintained. The exterior fabric also functions to hold the inner core assembly and cloth pads or foam cushions of the lower assembly 12 as well as the foam material of cushions 16–22 together as a single tight unit. The exterior fabric provides a protective covering which can withstand outside elements.

The cushions 16–22 are placed on lower assembly 12, offset with respect to the unions between the sections of the lower assembly for stability. The cushions 16–22 can be held in place on the lower assembly 12 with Velcro strips. The combination of lower assembly 12 and cushions 16–22 provide a plurality of interconnected seating units disposed around a circumference. The furniture unit 10 provides ample seating area for one or more persons. The users can sit, kneel, stretch out, and generally lounge on cushions 16–22 in a comfortable and socially conducive manner.

As a feature of furniture unit 10, an entertainment or user utilization center 24 is integrated into a central portion of the furniture unit. The entertainment center 24 has multiple uses and features. In one embodiment, entertainment center 24 is an open box or container having an interior volume for storage. The container is capable of holding many different items. For example, the container can be filled with soil suitable for sustaining plants or garden. The container can be lined with fire proof material and operates as a fire pit. The fire box can be fueled with gas or wood. The users can sit on cushions 16–22 and roast marshmallows over the open flame. Alternatively, the container can be arranged as an ornamental rock garden or storage receptacle for outdoor toys, games, and equipment. Items such as footballs, pool toys, and yard games can be stored in entertainment center 24.

In another embodiment, entertainment center 24 may have a lid or enclosure over the container. The lid can be provided with weather strips for moisture tight enclosure. The enclosure keeps the items inside entertainment center safe and secure from unauthorized access and weather elements. Items such as board games, books, papers, and other objects which are sensitive to outdoor elements can be stored in entertainment center 24 when it is provided with an enclosure over the container. An assortment of decorations, such as pictures, artwork, ornaments, and knick-knacks, can be placed on the top enclosure when in place. The top enclosure is ideal for the users to play board games or use as a table top surface for beverages and food items. The users can remove the board game from the storage area within entertainment center 24, replace the top enclosure, and then play the game on the top surface of the enclosure.

In other embodiments, the interior of entertainment center 24 can be used as a refrigeration unit for cold drinks and snacks. With the proper configuration, entertainment center 24 can be used as a water fountain or waterfall. The base 14 can be configured to receive electric power for the refrigeration unit, natural gas supply for the fire pit, or as a reservoir for the water fountain.

Accordingly, entertainment center 24 is a multipurpose integrated feature within furniture unit 10 which compliments the seating utilization of cushions 16–22 and lower assembly 12. The user can change the utilization of entertainment center 24 if desired. The multi-purpose features provided by entertainment center 24 are within convenient and easy reach of the users residing on the seating portion of the furniture unit 10.

Turning to FIG. 2, furniture unit 26 is shown having a similar construction as furniture unit 10. Furniture unit 26 has an entertainment center or user utilization center 28, similar to that shown FIG. 1. The entertainment center 28 has a top enclosure. The furniture unit 26 is surrounded by other furniture units for additional seating capacity. One such additional furniture unit is bench 30 having a back support 34 connected to the bench with back support bars 36. The other furniture units include bench 40 having a back support 42 connected to the bench with back support bars 44, bench 46 having a back support 48 connected to the bench with back support bars 50, and bench 52 having a back support 54 connected to the bench with back support bars 56. The back support bars 36, 44, 50, and 56 are angled to provide lumbar support. The back supports 34, 42, 48, and 54 may each have a back support inner core assembly. A cloth pad or cushion surrounds the back support inner core assembly. A durable fabric material encloses the back support inner core assemblies and back support pads. The back supports are shown as cylindrical in shape, although it may be rectangular or take other forms and shapes.

The benches 30, 40, 46, and 52 can remain detached as shown, or brought adjacent to, or into close proximity to, and/or attached to furniture unit 10. The benches maintain their close proximity by nature of the mass inertia of the units. The weight of the furniture units and coefficient of static friction of the support bases to the ground keep the units together as the composite assembly. Alternatively, the benches can be mechanically coupled to furniture unit 10 with latches, clamps, magnetic coupling, bracket, rods, velcro, and the like. The mechanically coupling mechanism provides additional strength and rigidity of the composite assembly.

The composite furniture grouping shown in FIG. 2 is quite versatile in its arrangement. For example, the benches can remain detached for adults to sit and socialize while the children play on furniture unit 10. The adults can keep their distance while monitoring the children's activities. The benches can be brought into close proximity to furniture unit 10 to increase the total seating capacity of the composite furniture assembly, e.g., units 10, 30, 40, 46, and 52 together. The entertainment center 24 continues to play a central role in the overall use and enjoyment of the composite furniture assembly.

In FIG. 3, an article of furniture 10 is designed for sitting purposes and shown as suitable for supporting the weight of one or more adult persons. Furniture unit 60 has a lower assembly 62 which rests on base 64. Base 64 can be made with wood, metal, or other suitable material capable of providing a stable structural support for furniture unit 60. The lower assembly 62 is made in four wedge-shaped sections. The side of one wedge-shaped section is placed adjacent to the side of another wedge-shaped section as shown in FIG. 3 to form a generally circular lower assembly 62. In one embodiment, the lower assembly 12 measures about 100 inches in diameter.

Each section of the lower assembly 62 has an inner core assembly (not shown). The inner core assembly has a box frame structure made with interconnected bars. A plurality of vertical bars connect between upper and lower bar components of the box frame around the inner core assembly. A plurality of horizontal bars connect across the upper portion of the box frame. The horizontal bars provide a structural weight-bearing support across the horizontal upper portion of the inner core assembly. The inner core assembly can be made of metal, wood, polymer, or other weight-bearing material. The inner core assembly is sufficiently rigid and sturdy to support the weight of one or more adult persons without noticeable bending or deformation. The structure of the inner core assembly maintains its shape and rigidity beyond the useful service life of the sitting furniture. The sides of inner core assembly are covered with cloth pad or foam cushions. The cloth pad or foam cushion side coverings may be 1–2 inches in thickness. A cloth pad or foam cushion top covering is disposed over the horizontal top portion of the inner core assembly. The lower assembly is then covered with a fabric material. The exterior fabric material is water proof, washable, and resistance to sun exposure and other outside elements.

An upper assembly of furniture unit 60 includes four cushions 66, 68, 70, and 72 made of foam or padded material. The cushions 66–72 are covered with a similar exterior fabric material as lower assembly 62. The exterior fabric provides a visually appealing and durable surface against outside elements which can be easily cleaned and maintained. The exterior fabric also functions to hold the inner core assembly and cloth pads or foam cushions of the lower assembly 62 as well as the foam material of cushions 66–72 together as a single tight unit. The exterior fabric provides a protective covering which can withstand outside elements.

The cushions 66–72 are placed on lower assembly 62, offset with respect to the unions between the sections of the lower assembly for stability. The cushions 66–72 can be held in place on the lower assembly 62 with Velcro strips. The combination of lower assembly 62 and cushions 66–72 provide a plurality of interconnected seating units disposed around a circumference. The furniture unit 60 provides ample seating area for one or more persons. The users can sit, kneel, stretch out, and generally lounge on cushions 66–72 in a comfortable and socially conducive manner.

As a feature of furniture unit 60, an entertainment or user utilization center 74 is integrated into a central portion of the furniture unit. The entertainment center 74 has multiple uses and features. In one embodiment, entertainment center 74 is an open box or container capable of holding or containing many different items. For example, the container can be filled with soil suitable for sustaining plants or garden. The container can be lined with fire proof material and operates as a fire pit. The container can be arranged as an ornamental rock garden or storage receptacle for outdoor toys, games, and equipment, e.g., footballs, pool toys, and yard games.

In another embodiment, entertainment center 74 may have a lid or enclosure over the container. The lid can be provided with weather strips for moisture tight enclosure. The enclosure keeps the items, such as board games, books, and papers, inside entertainment center safe and secure from unauthorized access and weather elements. An assortment of decorations, such as pictures, artwork, ornaments, and knick-knacks, can be placed on the top enclosure when in place. The top enclosure is ideal for the users to play board games or use as a table top surface for beverages and food items.

In other embodiments, the interior of entertainment center 74 can be used as a refrigeration unit for cold drinks and snacks. With the proper configuration, entertainment center 74 can be used as a water fountain or waterfall. The base 64 can be configured to receive electric power for the refrigeration unit, natural gas supply for the fire pit, or as a reservoir for the water fountain.

Accordingly, entertainment center 74 is a multipurpose integrated feature within furniture unit 60 which compliments the seating utilization of cushions 66–72 and lower assembly 62. The user can change the utilization of entertainment center 24 if desired. The multi-purpose features provided by entertainment center 74 are within convenient and easy reach of the users residing on the seating portion of the furniture unit 60.

In FIG. 4, a furniture unit 90 is shown having a similar construction as described in FIG. 3. Furniture unit 90 is surrounded by other furniture units for additional seating capacity. One such additional furniture unit is bench 100 having a back support 102 connected to the bench with back support bars 104. The other furniture units include bench 106 having a back support 108 connected to the bench with back support bars 110 and bench 112 having a back support 114 connected to the bench with back support bars 116. The back support bars 104, 110, and 104 are angled to provide lumbar support. The back supports 102, 108, and 114 may each have a back support inner core assembly. A cloth pad or cushion surrounds the back support inner core assembly. A durable fabric material encloses the back support inner core assemblies and back support pads. The back supports are shown as cylindrical in shape, although it may be rectangular or take other forms and shapes.

An entertainment center 120 is shown centrally located and integrated within furniture unit 90. The entertainment center 120 has multiple video screens 122 and 124 surrounding the unit for viewing by users from all angles around furniture unit 90. The video screen 122–124 can display video signals from DVD, VHS, and cable sources. The video screen can play the same video or have separate video feeds. Wired or wireless headset ports are provided within entertainment center 90.

The benches 100, 106, and 112 can remain detached as shown, or brought adjacent to, or into close proximity to, and/or attached to furniture unit 90. The benches maintain their close proximity by nature of the mass inertia of the units. The weight of the furniture units and coefficient of static friction of the support bases to the ground keep the units together as the composite assembly. Alternatively, the benches can be mechanically coupled to furniture unit 90 with latches, clamps, magnetic coupling, bracket, rods, velcro, and the like. The mechanically coupling mechanism provides additional strength and rigidity of the composite assembly.

The composite furniture grouping shown in FIG. 4 is quite versatile in its arrangement. For example, the benches can remain detached for adults to sit and socialize while the children play on furniture unit 90. The adults can keep their distance while monitoring the children's activities. The benches can be brought into close proximity to furniture unit 90 to increase the total seating capacity of the composite furniture assembly, e.g., units 90, 100, 106, and 112. The entertainment center 124 continues to play a central role in the overall use and enjoyment of the composite furniture assembly.

While one or more embodiments of the present invention have been illustrated in detail, the skilled artisan will appreciate that modifications and adaptations to those embodiments may be made without departing from the scope of the present invention as set forth in the following claims.

What is claimed is:

1. An assembly of outdoor furniture, comprising:

an open storage container having an interior volume;

a plurality of interconnected seating units disposed adjacent to and around the open storage container, the plurality of interconnected seating units having a cushion area extending substantially from an edge of the seating units to the open storage container; and a bench for contacting with one of the plurality of interconnected seating units.

2. The assembly of outdoor furniture of claim 1, wherein the bench is mechanically coupled to one of the plurality of interconnected seating units.

3. The assembly of outdoor furniture of claim 1, further including an enclosure covering the container.

4. The assembly of outdoor furniture of claim 1, wherein each of the plurality of interconnected seating units includes:

a lower assembly; and a cushion placed over the lower assembly.

5. The assembly of outdoor furniture of claim 1, wherein the plurality of interconnected seating units forms a rectangular or circular assembly.

6. The assembly of outdoor furniture of claim 1, wherein the open storage container houses an entertainment center.

7. The assembly of outdoor furniture of claim 6, wherein the entertainment center includes a video display unit.

8. The assembly of outdoor furniture of claim 6, wherein the entertainment center includes a refrigeration unit.

9. An assembly of outdoor furniture, comprising:

a plurality of seating units disposed around a circumference;

an entertainment center integrated into a central portion of the plurality of seating units, the plurality of seating units having a cushion area extending substantially from an edge of the seating units to the entertainment center; and a bench for contacting with one of the plurality of seating units.

10. The assembly of outdoor furniture of claim 9, wherein each of the plurality of seating units includes:

a lower assembly; and a cushion placed over the lower assembly.

11. The assembly of outdoor furniture of claim 9, wherein the plurality of seating units form a rectangular or circular assembly.

12. The assembly of outdoor furniture of claim 9, wherein the entertainment center includes a video display unit.

13. The assembly of outdoor furniture of claim 9, wherein the entertainment center includes a refrigeration unit.

14. A method of making an assembly of outdoor furniture, comprising:

providing a container having an interior volume for storage;

providing a plurality of interconnected seating units disposed adjacent to and around the container, the plurality of interconnected seating units having a cushion area extending substantially from an edge of the seating units to the container; and providing a bench for contacting with one of the plurality of interconnected seating units.

15. The method of claim 14, further including the step of providing an enclosure for covering the container.

16. The method of claim 14, further including the steps of:

providing a lower assembly; and providing a cushion placed over the lower assembly for each of the plurality of interconnected seating units.

17. The method of claim 14, further including forming the plurality of interconnected seating units as a rectangular or circular assembly.

18. The method of claim 14, further including the step of housing an entertainment center in the container.

19. The method of claim 18, wherein the entertainment center is a video display unit.

20. The method of claim 18, wherein the entertainment center is a refrigeration unit.

* * * * *